United States Patent [19]

Luckenbach et al.

[11] Patent Number: 4,666,584

[45] Date of Patent: May 19, 1987

[54] METHOD FOR PASSIVATING CRACKING CATALYST

[75] Inventors: Edward C. Luckenbach, Cobham, England; Carl F. Bertsch, Baton Rouge, La.

[73] Assignee: Exxon Research and Engineering Company, Florham Park, N.J.

[21] Appl. No.: 715,602

[22] Filed: Mar. 25, 1985

Related U.S. Application Data

[63] Continuation-in-part of Ser. No. 559,827, Dec. 9, 1983, abandoned.

[51] Int. Cl.[4] ..... B01J 37/18; B01J 37/16; B01J 38/18

[52] U.S. Cl. ..... 208/113; 502/6; 502/50; 502/521; 208/52 CT; 208/DIG. 1

[58] Field of Search ..... 208/113, 52 CT, 164, 208/DIG. 1; 502/50, 521, 6

[56] References Cited

U.S. PATENT DOCUMENTS

| | | | |
|---|---|---|---|
| 2,575,258 | 11/1951 | Corneil et al. | 502/521 |
| 2,901,419 | 8/1959 | Brill et al. | 208/119 |
| 3,213,014 | 10/1965 | Atkinson et al. | 208/164 |
| 3,408,286 | 10/1968 | Hepp et al. | 208/120 |
| 3,711,422 | 1/1973 | Johnson et al. | 252/414 |
| 3,857,794 | 12/1974 | Carey | 252/419 |
| 4,025,545 | 5/1971 | Mendicotta et al. | 269/465.7 |
| 4,031,002 | 6/1977 | McKay | 208/113 |
| 4,111,845 | 9/1978 | McKay | 252/455 |
| 4,141,858 | 2/1979 | McKay | 252/439 |
| 4,148,712 | 4/1979 | Nielsen et al. | 208/78 |
| 4,148,714 | 4/1979 | Nielsen et al. | 208/114 |
| 4,166,806 | 9/1979 | McKay et al. | 252/437 |
| 4,169,042 | 9/1979 | McKay | 208/113 |
| 4,208,302 | 6/1980 | McKay | 252/411 |
| 4,218,337 | 8/1980 | McKay | 252/411 |
| 4,238,317 | 12/1980 | Vasolos et al. | 208/120 |
| 4,256,564 | 3/1981 | Roberts et al. | 208/120 |
| 4,257,919 | 3/1981 | Roberts et al. | 502/64 |
| 4,268,416 | 5/1981 | Stine et al. | 502/521 |
| 4,280,895 | 7/1981 | Stuntz et al. | 502/53 |
| 4,280,896 | 7/1981 | Bearden et al. | 208/113 |
| 4,280,898 | 7/1981 | Tatterson et al. | 208/119 |
| 4,298,459 | 11/1981 | Tatterson et al. | 208/120 |
| 4,345,992 | 8/1982 | Washer et al. | 208/120 |
| 4,348,273 | 9/1982 | Nielsen | 208/113 |
| 4,361,496 | 11/1982 | Castillo et al. | 252/411 |
| 4,364,848 | 12/1982 | Castillo et al. | 252/411 |
| 4,370,220 | 1/1983 | Bearden et al. | 208/108 |
| 4,372,840 | 2/1983 | Bearden et al. | 208/113 |
| 4,372,841 | 2/1983 | Stuntz et al. | 208/113 |
| 4,377,470 | 3/1983 | Hettinger et al. | 208/120 |
| 4,386,015 | 5/1983 | Bertus et al. | 252/455 |
| 4,409,093 | 10/1983 | Bearden et al. | 208/108 |
| 4,439,536 | 3/1984 | Bertus et al. | 252/411 |
| 4,504,381 | 3/1985 | Bertsch | 208/113 |
| 4,522,704 | 6/1985 | Bertsch | 208/113 |

FOREIGN PATENT DOCUMENTS

| | | |
|---|---|---|
| 0038047 | 4/1981 | European Pat. Off. . |
| 0052356 | 11/1981 | European Pat. Off. . |
| 8203226 | 3/1981 | PCT Int'l Appl. . |
| 8204063 | 11/1982 | PCT Int'l Appl. . |
| 2124249 | 7/1983 | United Kingdom . |

OTHER PUBLICATIONS

"Deposited Metals Poison FCC Catalyst", Cimbalo et al, Oil & Gas Journal, May 5, '72, pp. 112–122.

*Primary Examiner*—Andrew H. Metz
*Assistant Examiner*—Chung K. Pak
*Attorney, Agent, or Firm*—Edward H. Mazer; Edward M. Corcoran

[57] ABSTRACT

A method and apparatus for passivating the adverse catalytic effects of metal contaminated hydrocarbon feedstocks is described. The method is directed at the use of control means to regulate the residence time of the catalyst in the passivation zone and to regulate the reducing gas flow rate to the passivation zone.

9 Claims, 2 Drawing Figures

METHOD FOR PASSIVATING CRACKING CATALYST

CROSS REFERENCE TO RELATED APPLICATIONS

This application is a continuation-in-part of U.S. Ser. No. 559,827, filed Dec. 9, 1983, now abandoned.

BACKGROUND OF THE INVENTION

The present invention is directed at a method for passivating adverse catalytic effects of metal contaminated cracking catalyst. More specifically, the present invention is directed at a method for providing improved passivation conditions and control in fluidized catalytic cracking units.

In the catalytic cracking of hydrocarbon feedstocks, particularly heavy feedstocks, vanadium, nickel and/or iron present in the feedstock becomes deposited on the cracking catalyst promoting excessive hydrogen and coke makes. These metal contaminants are not removed by conventional catalyst regeneration operations during which coke deposits on the catalyst are converted to CO and $CO_2$.

As used hereinafter, the term "passivation" is defined as a method for decreasing the detrimental catalytic effects of metal contaminants such as nickel, vanadium and iron which become deposited on catalyst. U.S. Pat. Nos. 3,711,422; 4,025,545; 4,031,002; 4,111,845; 4,141,858; 4,148,712; 4,148,714; and 4,166,806 are all directed to the contacting of the cracking catalyst with antimony compounds to passivate the catalytic activity of the iron, nickel and vanadium contaminants deposited on the catalyst. However, antimony compounds alone may not passivate the metal contaminants to sufficiently low levels, particularly where the metal contaminant concentration on the catalyst is relatively high.

Cimbalo, Foster and Wachtel, in an article entitled "Deposited Metals Poison FCC Catalyst", published at pages 112–122 of the May 15, 1972 issue of Oil and Gas Journal, disclose that the catalytic activity of metal contaminants decrease with repeated oxidation and reduction cycles.

U.S. Pat. No. 2,575,258 discloses the use of a reducing gas to decrease the adverse catalytic effects of ferrous contaminants in a cracking system. Reducing gas at an elevated temperature may be introduced through a plurality of points into the transfer line between the regeneration zone and the reaction zone to decrease adverse catalytic effects of the iron contaminant. One embodiment discloses the use of a valve in the transfer line between the regeneration and reaction zones to direct regenerated catalyst from the transfer line through a separate passivation zone.

U.S. Pat. Nos. 4,280,895 and 4,280,896 disclose a method for passivating metal contaminated cracking catalyst by passing the cracking catalyst through a passivation zone having a reducing atmosphere maintained at an elevated temperature for a period of time ranging between 30 seconds and 30 minutes, typically from about 2 to about 5 minutes.

U.S. Pat. No. 4,298,459 describes a process for cracking a metals containing feedstock where the cracking catalyst is subjected to alternate exposures of up to 30 minutes in an oxidizing zone and in a reducing zone maintained at an elevated temperature to thereby reduce the hydrogen and coke makes. U.S. Pat. Nos. 4,268,416; 4,361,496; and 4,364,848; and PCT Patent Publication No. WO/04063 all describe methods for passivating cracking catalyst in which metal contaminated cracking catalyst is contacted with a reducing gas at elevated temperatures to passivate the catalyst.

European Patent Publication No. 52,356 discloses the use of a reducing gas passivation zone having a residence time of about 3 seconds to about 2 hours for passivating the adverse effects of metal contaminants present on cracking catalyst.

U.S. Pat. Nos. 4,372,840 and 4,372,841 also disclose the use of a high temperature reducing atmosphere for metals passivation. These patents further disclose that addition of a hydrogen donor material to the reaction zone reduces the hydrogen and coke makes.

U.S. Pat. No. 3,857,794 discloses the addition of CO to the regeneration zone to decrease or eliminate afterburning.

U.S. Pat. No. 3,408,286 discloses the use of a valve in the transfer line between a reaction zone and a regeneration zone. This patent also discloses addition of a feed slipstream upstream of the valve to displace combustion gases from the interstices of the catalyst.

U.S. Pat. No. 4,345,992 discloses the addition of a reducing gas between the disengaging zone and the reaction zone to passivate metal contaminants on cracking catalyst. This patent also discloses the use of a gaseous seal upstream of the reducing gas addition point to minimize the amount of reducing gas flowing into the disengaging zone.

It would be advantageous to utilize the standpipe and/or U-bend of the cracking system between the regeneration zone and the cracking zone as a passivation zone to passivate cracking catalyst, if this passivation zone provides a sufficient residence time and if the use of the standpipe and/or U-bend as a transfer line does not cause any operational problems.

It is desirable to provide a process in which the catalyst may be passivated without the installation of a separate passivation vessel.

It also is desirable to provide a process in which the residence time of the catalyst in the passivation zone is controllable.

It also is desirable to provide a process in which the flow of reducing gas into the regeneration zone is minimized.

It also is desirable to provide a process in which the flow of reducing gas may be regulated during process upsets.

The present invention is directed at a method for regulating the residence time of regenerated catalyst in a transfer line disposed between the reaction and regeneration zones. The present invention also is directed at the monitoring of key process variables in the cracking system and regulating the rate of addition of reducing gas in response to these variables. Passivation promoters or rate enhancers such as antimony, tin, bismuth, maganese, cadmium, germanium, indium, tellurium and zinc may be added to increase the rate of passivation.

SUMMARY OF THE INVENTION

A method for reducing the adverse catalytic effects of a metal contaminant selected from the group consisting of nickel, vanadium, iron and mixtures thereof present in a hydrocarbon feedstock processed in a cracking system of the type comprising a reaction zone, a regeneration zone, and transfer means communicating between the reaction zone and the regeneration zone, said method comprising:

A. contacting the feedstock containing the metal contaminant with cracking catalyst in the reaction zone under cracking conditions to produce cracked product and coke, coke and metal contaminant being deposited on the cracking catalyst;

B. passing coke and metal contaminated catalyst from the reaction zone to the regeneration zone maintained under regeneration conditions to remove coke from the catalyst;

C. passing metal contaminated catalyst through a passivation zone maintained under net reducing conditions at an elevated temperature, the passivation zone disposed in a catalyst transfer means adapted to return regenerated catalyst to the reaction zone, the transfer means having a flow control means adapted to regulate the flow rate of regenerated catalyst from the regeneration zone to the reaction zone; and, D. monitoring the catalyst level in the transfer means and/or in the regeneration zone and regulating the flow control means in response thereto to thereby regulate the residence time of the catalyst in the passivation zone.

In a preferred embodiment passivation promoters, or passivation rate enhancers, such as antimony, tin, bismuth, manganese, germanium, cadmium, indium, tellurium and zinc may be added.

The catalyst transfer means may comprise the standpipe and/or U-bend, depending upon the desired residence time. The flow control means preferably comprises a single or multiple slide valve, and preferably is disposed in the standpipe, although a location in the rising side of the U-bend transfer line is an alternative. Reducing gas preferably is added to the standpipe and/or U-bend through a plurality of locations. To prevent the flow of an excess amount of reducing gas through the transfer means, the reducing gas flow rate preferably is controlled by a control means regulated by the temperature in the regeneration zone and/or the catalyst circulation rate.

DETAILED DESCRIPTION OF THE INVENTION

Figure 1:
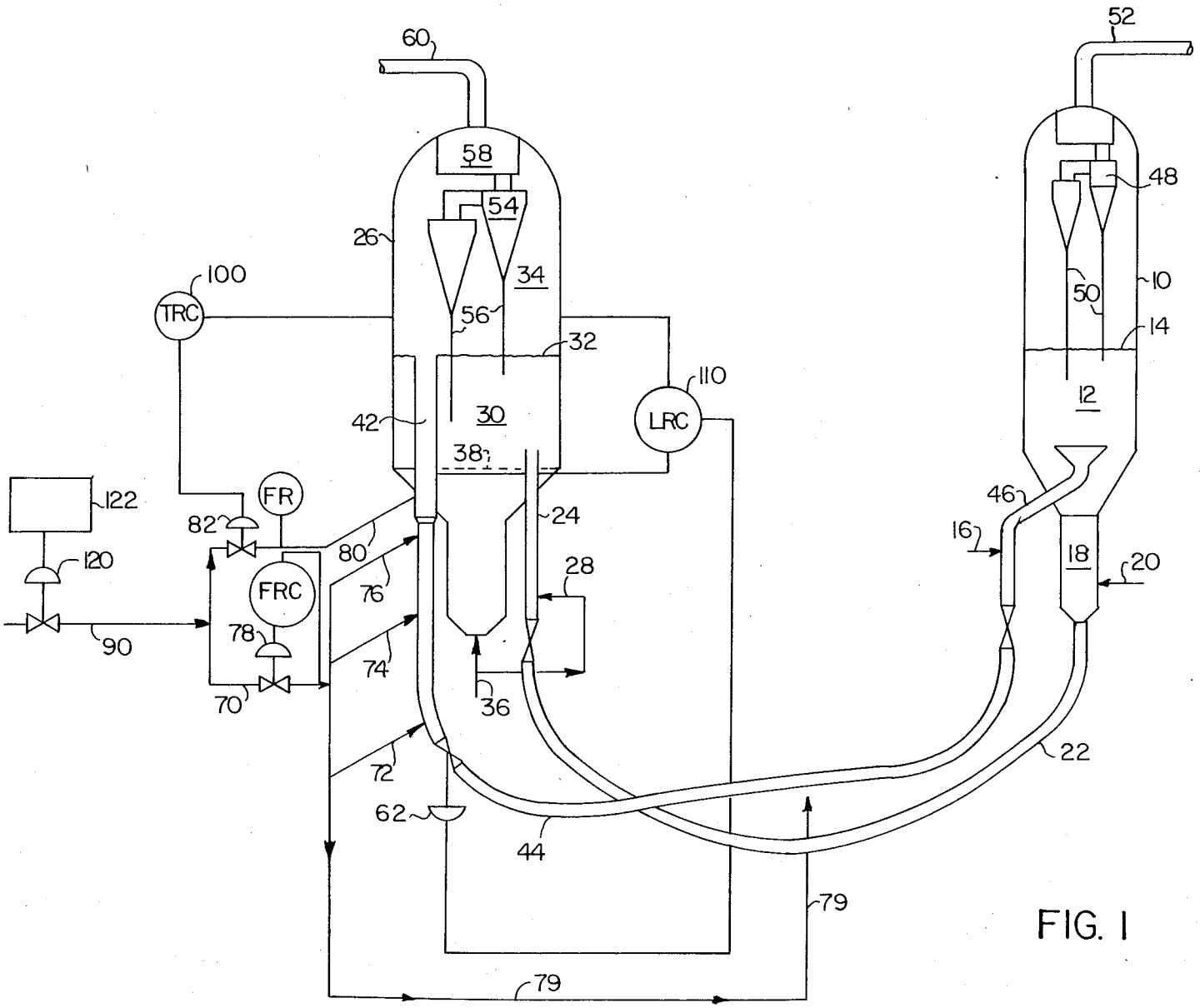
FIG. 1 is a simplified flow diagram of a fluidized catalytic cracking unit employing the subject invention.

Referring to the FIG. 1, the present invention is shown as applied to a typical fluid catalytic cracking process. Various items, such as pumps, compressors, steam lines, instrumentation and other process equipment have been omitted to simplify the drawing. Reaction or cracking zone 10 is shown containing a fluidized catalyst bed 12 having a level at 14 in which a hydrocarbon feedstock is introduced into the fluidized bed through line 16 for catalytic cracking. The hydrocarbon feedstock may comprise naphthas, light gas oils, heavy gas oils, residual fractions, reduced crude oils, cycle oils derived from any of these, as well as suitable fractions derived from shale oil, kerogen, tar sands, bitumen processing, synthetic oils, coal hydrogenation, and the like. Such feedstocks may be employed singly, separately in parallel reaction zones, or in any desired combination. Typically, these feedstocks will contain metal contaminants such as nickel, vanadium and/or iron. Heavy feedstocks typically contain relatively high concentrations of vanadium and/or nickel, as well as coke precursors, such as Conradson carbon materials. The amount of Conradson carbon material present may be determined by ASTM test D189-65, the disclosure of which is incorporated herein by reference. Hydrocarbon gas and vapors passing through fluidized bed 12 maintain the bed in a dense turbulent fluidized condition.

In reaction zone 10 the cracking catalyst becomes spent during contact with the hydrocarbon feedstock due to the deposition of coke thereon. thus, the terms "spent" or "coke contaminated" catalyst as used herein generally refer to catalyst which has passed through a reaction zone and which contains a sufficient quantity of coke thereon to cause activity loss, thereby requiring regeneration. Generally, the coke content of spent catalyst can vary anywhere from about 0.5 to about 5 weight percent or more. Typically, spent catalyst coke contents vary from about 0.5 to about 1.5 weight percent.

Prior to actual regeneration, the spent catalyst is usually passed from reaction zone 10 into a stripping zone 18 and contacted therein with a stripping gas, which is introduced into the lower portion of zone 18 via line 20. The stripping gas, which is usually introduced at a pressure of from about 10 to about 50 psig, serves to remove most of the volatile hydrocarbons from the spent catalyst. A preferred stripping gas is steam, although nitrogen, other inert gases, or flue gas may be employed. Normally, the stripping zone is maintained at essentially the same temperature as the reaction zone, i.e., from about 450° C. to about 600° C. Stripped spent catalyst from which most of the volatile hydrocarbons have been removed is then passed from the bottom of stripping zone 18, through U-bend 22 and into a connecting vertical riser 24 which extends into the lower portion of regeneration zone 26. Air is added to riser 24 via line 28 in an amount sufficient to reduce the density of the catalyst flowing therein, thus causing the catalyst to flow upwardly into regeneration zone 26 by simple hydraulic balance.

In the particular configuration shown, the regeneration zone is a separate vessel (arranged at approximately the same level as reaction zone 10) containing a dense phase catalyst bed 30 having a level indicated at 32, which is undergoing regeneration to burn-off coke deposite formed in the reaction zone during the cracking reaction, above which is a dilute catalyst phase 34. An oxygen-containing regeneration gas enters the lower portion of the regeneration zone 26 via line 36 and passes up through a grid 38 and the dense phase catalyst bed 30, maintaining said bed in a turbulent fluidized condition similar to that present in reaction zone 10. Oxygen-containing regeneration gases which may be employed in the process of the present invention are those gases which contain molecular oxygen in admixture with a substantial portion of an inert diluent gas. Air is a particularly suitable regeneration gas. An additional gas which may be employed is air enriched with oxygen. Additionally, if desired, steam may be added to the dense phase bed along with the regeneration gas or separately therefrom to provide additional inert diluents and/or fluidization gas. Typically, the specific vapor velocity of the regeneration gas will be in the range of from about 0.8 to about 6.0 feet/sec., preferably from about 1.5 to about 4 feet/sec.

In regeneration zone 26, flue gases formed during regeneration of the spent catalyst pass from the dense phase catalyst bed into the dilute catalyst phase 34 along with entrained catalyst particles. The catalyst particles are separated from the flue gas by a suitable gas/solid separation means 54 and returned to the dense phase catalyst bed 30 via diplegs 56. The substantially catalyst-free flue gas then passes into a plenum chamber 58 prior to discharge from the regeneration zone 26 through line 60. Regeneration zone 26 may be operated in a net oxidizing or a net reducing mode. Regeneration zone 26 preferably is operated in a net reducing mode, i.e., insufficient oxygen is added to completely combust the coke. The flue gas exiting from regeneration zone 26 typically will comprise about 1–10 volume percent CO, preferably about 6–8 volume percent CO. The oxygen content of the flue gas preferably will be less than 0.5 volume percent, more preferably less than 0.1 volume percent, and most preferably less than 200 parts per million by volume.

Regenerated catalyst from the dense phase catalyst bed 30 in the regeneration zone 26 flows downwardly through a catalyst transfer means comprising standpipe 42 and U-bend 44 prior to again entering cracking zone 10. In this embodiment standpipe 42 and/or U-bend 44 may be utilized as a passivation zone, thereby obviating the necessity for the installation of a separate passivation zone. To assure that standpipe 42 and/or U-bend 44 provide a sufficient residence for the passivation, a control means, such as control valve 62 is installed in the transfer means, preferably in standpipe 42, to regulate the catalyst level in the standpipe. Reducing gas preferably is added to standpipe 42 at a plurality of points through lines 72, 74, 76, and 80 to fluidize as well as passivate the catalyst. Reducing gas also may be added to U-bend 44 as, for example, through line 79, to provide additional reducing gas for passivating and fluidizing the gas, should this prove necessary.

A control system preferably is disposed in standpipe 42 of the catalyst transfer means to govern the rate of addition of reducing gas and/or the catalyst level in standpipe 42. Control valves 78 and 82 preferably are installed in reducing gas lines 70 and 80, respectively to regulate the reducing gas addition rate to standpipe 42. Control valve 82 preferably is regulated by the temperature in regeneration zone 26, for example, through temperature recorder controller 100, to assure an adequate flow of reducing gas while not providing an excessive flow. Excess reducing gas flow through standpipe 42 would be combusted in dilute phase 34, resulting in an excessively high temperature in the dilute phase. Control valve 82 preferably should regulate the flow of reducing gas to maintain the temperature in dilute phase 34 below a maximum temperature of about 760° C. Control valve 62 preferably communicates with a level control means, such as level recorder controller 110, to maintain the catalyst level in standpipe 42 and/or regeneration zone 26 within the desired limits. If the level in standpipe 42 and/or regeneration zone 26 builds-up above a desired level, level-recorder-controller 110 will direct control valve 62 to open more until the level in standpipe 42 and/or regeneration zone 26 is back within the desired limits. Conversely, when the level in standpipe 42 drops below a predetermined level, control valve 62 may be closed an additional amount. An additional control means, control valve 120, is shown disposed in reducing gas line 90 to provide a means to control reducing gas to the entire system. Control valve 120 could be connected to appropriate sensing means 122 to decrease or cut-off flow of reducing gas to the entire system in the event of operational upsets, such as a significant temperature rise in regeneration zone 26, a stoppage or significant decrease in the catalyst circulation through the system, or other process upset.

The residence time required for passivation of the catalyst will be be dependent, in part, on the passivation temperature utilized, the reducing gas utilized, the metals level on the catalyst, and the degree of passivation desired. It has been found that the rate of passivation increases with increasing temperature. The temperature utilized for passivating the catalyst should be maintained above about 500° C., preferably above about 600° C., but below the temperature at which the catalyst sinters or degrades. A preferred temperature range is about 600° C. to about 850° C., with the more preferred temperature range being from about 650° C. to about 750° C. Accordingly, where it is desired to passivate the metal contaminants sufficiently in standpipe 42 and/or transfer line 44 without the further addition of a separate passivation vessel, the temperature in standpipe 42 and/or transfer line 44 utilized for passivation should be maintained within the above-noted temperature ranges.

Typical catalyst residence times in the passivation zone may range between about 15 seconds and about 3 minutes, preferably between about 30 seconds and about 2 minutes. Since the residence time of regenerated catalyst in standpipe 42 and U-bend 44 without the use of control means 62 typically ranges between about 20 seconds and about 30 seconds, the necessity for increasing the residence time by the installation of a control means in these cracking systems can be appreciated. To provide a sufficient degree of passivation in the rather limited residence time of the catalyst in the passivation zone, it may be necessary to add passivation promoters or passivation rate enhancers, such as antimony, tin, bismuth manganese germanium, indium, tellurium and zinc. The use of antimony, tin, bismuth and manganese is described in U.S. Pat. Nos. 4,280,895 and 4,280,896 and European Patent Publication No. 52,356, and disclosures of which are incorporated herein by reference. The use of cadmium, germanium, indium, tellurium, zinc and tin is described in U.S. patent application Ser. No. 559,891, filed Dec. 9, 1983, now U.S. Pat. No. 4,522,704 and Ser. No. 559,918, filed Dec. 9, 1983, now U.S. Pat. No. 4,504,381, the disclosures of which are incorporated herein by reference.

By regenerated catalyst is meant catalyst leaving the regeneration zone which has contacted an oxygen-containing gas causing at least a portion, preferably a substantial portion, of the coke present on the catalyst to be removed. More specifically, the carbon content of the regenerated catalyst can vary anywhere from about 0.01 to about 0.4 weight percent, but preferably is from about 0.01 to about 0.1 weight percent. Predetermined quantities of passivation promoters and/or rate enhancers may be added to the hydrocarbon feedstock through line 16, if desired. The hydrocarbon feedstock for the cracking process, containing minor amounts of iron, nickel and/or vanadium contaminants, is injected into line 46 through line 16 to form an oil and catalyst mixture which is passed into fluid bed 12 within reaction zone 10. The metal contaminants and the passivation promoter, if any, become deposited on the cracking catalyst. Product vapors containing entrained catalyst particles pass overhead from fluid bed 12 into a gas-solid separation means 48 wherein the entrained catalyst particles are separated therefrom and returned through diplegs 50 leading back into fluid bed 12.

The construction of regeneration zone 26 can be of any material sufficiently able to withstand the relatively high temperatures involved when after-burning is encountered within the vessel and the high attrition conditions which are inherent in systems wherein fluidized catalyst is regenerated and transported. Specifically, metals are contemplated which may or may not be lined. More specifically, ceramic liners are contemplated within any and all portions of the regeneration zone, together with alloy use and structural designs in order to withstand temperatures of about 760° C. and, for reasonably short periods of time, temperatures which may be as high as 1000° C.

The pressure in the regeneration zone is usually maintained in a range from about atmospheric to about 50 psig, preferably from about 10 to 50 psig. It is preferred, however, to design the regeneration zone to withstand pressures of up to about 100 psig. Operation of the regeneration zone at increased pressure has the effect of promoting the conversion of carbon monoxide to carbon dioxide and reducing the temperature level within the dense bed phase at which the substantially complete combustion of carbon monoxide can be accomplished. The higher pressure also lowers the equilibrium level of carbon on regenerated catalyst at a given regeneration temperature.

The utilization of standpipe 42 and U-bend 44 for the practice of the present invention may necessitate changes in the materials of construction to insure that there is no embrittlement, particularly if the reducing gas utilized includes hydrogen. where the reducing gas includes hydrogen, standpipe 42 and U-bend 44 may be constructed of materials more resistant to the process conditions, such as 304H stainless steel rather than the 304 stainless steel.

Control valve 62, normally will be of a type which will afford substantially unimpeded catalyst flow through standpipe 42 when fully open. Preferred types of valves are slide valves specifically designed for fluid solids flows.

The slide valve may have an orifice plate disposed above or below the slide plate. If the orifice plate is above the slide plate special fluidization must be provided to insure that movement of the slide is possible. Typical valves are shown in U.S. Pat. No. 4,253,487, the disclosure of which is incorporated herein by reference. Control valve 62 also must be operable at the severe conditions which will be experienced in standpipe 42. Preferred materials of construction would be those previously noted for standpipe 42 and U-bend 44. While control valve 62 has been shown disposed in standpipe 42, it is within the contemplation of this invention that control valve 62 also could be installed in U-bend 44.

The present invention may be applied beneficially to any type of fluid cat cracking unit without limitation as to the spatial arrangement of the reaction, stripping, and regeneration zones. The present invention may be particularly useful where it is not desirable or feasible to install a separate passivation vessel. In general, any commercial catalytic cracking catalyst designed for high thermal stability could be suitably employed in the present invention. Such catalysts include those containing silica and/or alumina. Catalysts containing combustion promoters, such as platinum, can be used. Other refractory metal oxides, such as magnesia or zirconia, may be employed and are limited only by their ability to be effectively regenerated under the selected conditions. With particular regard to catalytic cracking, preferred catalysts include the combinations of silica and alumina containing 10 to 50 weight percent alumina, and particularly their admixtures with molecular sieves or crystalline aluminosilicates. Suitable molecular sieves include both naturally occurring and synthetic aluminosilicate materials, such as faujasite, chabazite, X-type and Y-type aluminosilicate materials, and ultra stable, large pore crystalline aluminosilicate materials. When admixed with, for example, silica-alumina to provide a petroleum cracking catalyst, the molecular sieve content of the fresh finished catalyst particles is suitable within the range of from 5–35 weight percent, preferably 8–20 weight percent. An equilibrium molecular sieve cracking catalyst may contain as little as 1 weight percent crystalline material. Admixtures of clay-extended aluminas may also be employed. Such catalysts may be prepared in any suitable method, such as by impregnation, milling, co-gelling, and the like, subject only to the provision that the finished catalyst be in a physical form capable of fluidization.

In the practice of the present invention it is anticipated that any process reducing gases, such as hydrogen streams, cat cracker tail gas, catalytic reformer tail-gas, spent hydrogen streams from catalytic hydroprocessing, synthesis gas, steam cracker gas, flue gas and mixtures thereof, would be suitable. The required reducing gas flow rate will be a function of several variables, including the catalyst flow rate, contaminant metals level on catalyst, process reducing gas utilized, and the desired degree of passivation.

The utility of passivation promoters or passivation rate enhancers in combination with a passivation zone having a relatively short residence time may be seen from the following examples in which cadmium, germanium, indium, tellurium, zinc, cadmium and tin are utilized. In these tests, samples of previously used Super-DX cracking catalyst, a silica alumina catalyst manufactured by Davison Chemical Company, a division of W. R. Grace and Company, was impregnated with 1000 wppm nickel and 4000 wppm vanadium. Samples were passivated at 704° C. without the addition of any passivation promoter. The Gas Producing Factor (GPF), a direct measure of the metal contaminant activity, obtained by a microactivity test (MAT) as described in ASTM D3907-80, was measured with samples having differing passivation zone residence times. The results are shown in Table I. The GPF is described in detail by Earl C. Gossett, "When Metals Poison Cracking Catalyst", *Petroleum Refiner,* Vol. 39, No. 6, June 1980, pp. 177–180, the disclosure of which is incorporated herein by reference.

TABLE I

EFFECT OF HYDROGEN PASSIVATION ON CRACKING CATALYST ACTIVITY

| Catalyst Residence Time in Hydrogen Passivation Zone (min) | Gas Producing Factor (GPF) | Degree of Passivation ($GPF/GPF_o$) |
|---|---|---|
| 0 | 19.0 ($GPF_o$) | 1.0 |
| 5 | 15.6 | 0.82 |
| 8 | 13.9 | 0.73 |
| 10 | 12.9 | 0.68 |
| 20 | 9.5 | 0.50 |
| 40 | 7.5 | 0.39 |
| 60 | 6.5 | 0.34 |
| 90 | 5.8 | 0.31 |
| 2 hr | 5.5 | 0.29 |

TABLE I-continued

| EFFECT OF HYDROGEN PASSIVATION ON CRACKING CATALYST ACTIVITY | | |
|---|---|---|
| Catalyst Residence Time in Hydrogen Passivation Zone (min) | Gas Producing Factor (GPF) | Degree of Passivation ($GPF/GPF_o$) |
| 3 hr | 5.3 | 0.28 |
| 4 hr | 5.0 | 0.26 |

Separate samples of this same metal contaminant-impregnated Super-DX catalyst were impregnated with 2000 wppm of cadmium, germanium, indium, tellurium and zinc. These results are reported in Tables II, III, IV, V and VI, respectively.

EXAMPLE 1

Samples of the Super-DX metal contaminated cracking catalyst having 2000 wppm of each of the above-noted passivation promoters were placed in a passivation zone maintained at 704° C. for varying residence times after which the GPF of the passivated catalysts were determined. Tables II, III, IV, V and VI present the gas producing factors and degree of passivation for the passivated catalyst samples impregnated with cadmium, germanium, indium, tellurium, and zinc, respectively. Tables II–VI also present the GPF predicted from the additive effect of hydrogen passivation and the use of passivation promoters. The degree of passivation achieved by hydrogen alone. The GPF for the promoted samples without hydrogen passivation denoted as $GPF_o$ was used to estimate the individual contribution from the passivation promoter alone. The predicted combination of these effects for metal passivation was calculated as follows: GPF predicted=(Individual effect of hydrogen passivation at each residence time)+(GPF for promoted sample with no hydrogen passivation). The degree of passivation attributable to hydrogen passivation at each residence time is $$\left(\frac{GPF}{GPF_{o,base}}\right) \text{ at residence time} \cdot (GPF_{o,\,base})$$

The degree of passivation attributable to the passivation promoter is $$\left(1 - \frac{GPF_{o\ additive}}{GPF_{obase}}\right) \cdot (GPF_{pass})$$

where $GPF_{o\ base}$=GPF with no hydrogen passivation and no passivation promoter $GPF_{o,\ additive}$=GPF with no hydrogen passivation, but with the passivation promoter present $GPF_{pass}$=GPF measured for hydrogen passivation at indicated time with no passivation promoter present As may be seen from Tables II–VI, at short passivation zone residence times, i.e., less than about 10 minutes, when each of the passivation promoted catalyst samples is passivated, the reduction in the gas producing factors is greater than the additive effect for the individual reductions in the gas producing factor for hydrogen passivation at a given passivation zone residence time and temperature, and the effect of the metal passivation additive.

TABLE II

| CRACKING CATALYST IMPREGNATED WITH 2000 WPPM CADMIUM | | | | |
|---|---|---|---|---|
| Cracking Catalyst Residence Time in Hydrogen Passivation Zone (min) | Measured Gas Producing Factor (GPF Meas) | $GPF/GPF_o$ | GPF Predicted | Δ (Meas. − Pred.) |
| 0 | 18.3 ($GPF_o$) | 1.0 | 18.3 | 0 |
| 5 | 12.1 | 0.66 | 15.0 | −2.9 |
| 8 | 8.5 | 0.46 | 13.4 | −4.9 |
| 10 | 8.1 | 0.44 | 12.4 | −4.3 |
| 20 | 5.5 | 0.30 | 9.1 | −3.7 |
| 40 | 5.4 | 0.30 | 7.1 | −1.7 |
| 90 | 4.8 | 0.26 | 5.7 | −0.9 |
| 180 | 3.9 | 0.21 | 5.1 | −1.2 |

TABLE III

| CRACKING CATALYST IMPREGNATED WITH 2000 WPPM ZINC | | | | |
|---|---|---|---|---|
| Cracking Catalyst Residence Time in Hydrogen Passivation Zone (min) | Measured Gas Producing Factor (GPF Meas) | $GPF/GPF_o$ | GPF Predicted | Δ (Meas. − Pred.) |
| 0 | 18.5 ($GPF_o$) | 1.0 | — | — |
| 5 | 12.8 | 0.69 | 15.2 | −2.4 |
| 10 | 10.5 | 0.57 | 12.6 | −2.1 |
| 20 | 8.3 | 0.45 | 9.3 | −1.0 |
| 40 | 9.2 | 0.50 | 7.2 | +2.0 |
| 90 | 6.2 | 0.34 | 5.7 | +0.5 |
| 180 | 6.0 | 0.32 | 5.2 | +0.8 |

TABLE IV

| CRACKING CATALYST IMPREGNATED WITH 2000 WPPM INDIUM | | | | |
|---|---|---|---|---|
| Cracking Catalyst Residence Time in Hydrogen Passivation Zone (min) | Measured Gas Producing Factor (GPF Meas) | $GPF/GPF_o$ | GPF Predicted | Δ (Meas. − Pred.) |
| 0 | 16.4 ($GPF_o$) | 1.0 | — | — |
| 5 | 11.6 | 0.71 | 13.4 | −1.8 |
| 8 | 10.4 | 0.63 | 12.0 | −1.6 |
| 10 | 9.3 | 0.57 | 11.2 | −1.9 |
| 20 | 7.8 | 0.48 | 8.2 | −0.4 |
| 40 | 8.3 | 0.51 | 6.4 | +1.9 |
| 60 | 4.9 | 0.30 | 5.6 | −0.7 |
| 120 | 4.0 | 0.24 | 4.8 | −0.8 |

TABLE V

| CRACKING CATALYST IMPREGNATED WITH 2000 WPPM GERMANIUM | | | | |
|---|---|---|---|---|
| Cracking Catalyst Residence Time in Hydrogen Passivation Zone (min) | Measured Gas Producing Factor (GPF Meas) | $GPF/GPF_o$ | GPF Predicted | Δ (Meas. − Pred.) |
| 0 | 15.3 ($GPF_o$) | 1.0 | — | — |
| 5 | 9.8 | 0.64 | 12.5 | −2.7 |
| 10 | 8.8 | 0.58 | 10.4 | −1.6 |
| 20 | 8.3 | 0.54 | 7.7 | +0.6 |
| 40 | 6.2 | 0.41 | 6.0 | +2.0 |
| 90 | 5.0 | 0.33 | 4.7 | +0.3 |
| 180 | 4.8 | 0.31 | 4.3 | +0.5 |

TABLE VI

| CRACKING CATALYST IMPREGNATED WITH 2000 WPPM TELLURIUM | | | | |
|---|---|---|---|---|
| Cracking Catalyst Residence Time in Hydrogen Passivation Zone (min) | Measured Gas Producing Factor (GPF Meas) | $GPF/GPF_o$ | GPF Predicted | Δ (Meas. − Pred.) |
| 0 | 16.6 ($GPF_o$) | 1.0 | — | — |
| 5 | 12.1 | 0.73 | 13.6 | −1.5 |
| 8 | 9.4 | 0.57 | 12.1 | −2.7 |
| 10 | 9.2 | 0.55 | 11.3 | −2.1 |
| 40 | 9.4 | 0.57 | 6.5 | +2.9 |
| 90 | 7.8 | 0.47 | 5.1 | +2.7 |
| 180 | 6.9 | 0.42 | 4.6 | +2.3 |

Another sample of Super-DX metal contaminated cracking catalyst having 1000 wppm Ni and 4000 wppm V was passivated at 704° C. without the addition of any passivation promoter. This catalyst exhibited higher metal contaminant activity as compared with that used in the previous tests. The Gas Producing Factor again was measured at different passivation zone residence times to measure the metal contaminant activity. The results are shown in Table VII.

ated sample was measured. The results are also presented in Table VII. As may be seen from Table VII, at short passivation zone residence times, i.e., less than about 30 minutes, the reduction in the Gas Producing Factor for the passivation promoted sample is greater than the additive effect for the individual reductions in the GPF for hydrogen passivation at a given passivation zone residence time and temperature and the metals passivation additive.

TABLE VII

| CRACKING CATALYST IMPREGNATED WITH 250 WPPM CADMIUM | | | | | | |
|---|---|---|---|---|---|---|
| Cracking Catalyst | Base (no Cadmium) | | Catalyst With 250 wppm Cadmium | | | |
| Residence Time in Hydrogen Passivation Zone (min) | Measured Gas Producing Factor (GPF Meas) | $GPF/GPF_o$ | GPF Meas | $GPF/GPF_o$ | GPF Predicted | Δ (Meas. − Pred.) |
| 0 | 26.9 ($GPF_o$) | 1.0 | 28.9 ($GPF_o$) | 1.0 | — | — |
| 5 | 25.1 | .93 | 24.0 | .83 | 26.9 | −2.9 |
| 10 | 18.4 | .68 | 13.1 | .45 | 19.7 | −6.6 |
| 30 | 16.0 | .61 | 8.8 | .31 | 17.6 | −8.8 |
| 60 | 8.9 | .33 | 6.7 | .23 | 9.5 | −2.8 |

EXAMPLE II

A sample of this second Super-DX metal contaminated catalyst was impregnated with only 250 wppm of cadmium. The catalyst sample was passivated for varying residence times, after which the GPF of the passiv- Thus, Tables I–VII demonstrate that the present invention is of particular utility in situations where the passivation zone residence time is relatively short, such as when a transfer line passivation zone is utilized.

Tables VIII and IX demonstrate that the unexpected reduction in the Gas Producing Factor may be affected by the passivation zone temperature.

A third sample of Super-DX metal contaminated cracking catalyst having 800 wppm NI and 2400 wppm V was placed in a passivation zone for varying times at 593° C. and 649° C. to determine the GPF at different passivation zone residence times.

EXAMPLE III

These catalyst samples also were impregnated with 1000 wppm cadmium and the tests repeated. From Table VII it may be seen that the unexpected reduction in the GPF shown in Table II for cadmium at 704° C. is not realized at 593° C., or 649° C. This illustrates that, at short residence times, it may be necessary to maintain the passivation zone above a predetermined temperature for effective metals passivation.

TABLE VIII

CRACKING CATALYST IMPREGNATED WITH 1000 WPPM CADMIUM; PASSIVATION ZONE TEMPERATURE 593° C.

| Cracking Catalyst Residence Time in Hydrogen Passivation Zone (min) | No Cadmium Measured Gas Producing Factor (GPF Meas) | 1000 wppm Cadmium Measured Gas Producing Factor (GPF Meas) |
|---|---|---|
| 0 | 14.7 | 15.9 |
| 5 | 11.8 | 14.6 |
| 10 | 12.3 | 15.8 |
| 30 | 11.5 | 15.7 |
| 60 | 11.2 | 15.1 |

TABLE IX

CRACKING CATALYST IMPREGNATED WITH 1000 WPPM CADMIUM; PASSIVATION TEMPERATURE 649° C.

| Cracking Catalyst Residence Time in Hydrogen Passivation Zone (min) | No Cadmium Measured Gas Producing Factor (GPF Meas) | 1000 wppm Cadmium Measured Gas Producing Factor (GPF Meas) |
|---|---|---|
| 0 | 14.7 | 14.8 |
| 5 | 13.1 | 15.6 |
| 10 | 12.2 | 15.2 |
| 30 | 10.6 | 12.4 |
| 60 | 8.5 | 10.1 |

EXAMPLE IV

Separate samples of metal contaminant impregnated Super DX catalyst were impregnated with 2000 wppm of cadmium, or with 2000 wppm of tin. The GPF of the unpassivated catalyst was determined and is presented in Table X and FIG. 2. Samples of these catalysts also were placed in a passivation zone maintained at 704° C. for varying residence times after which the GPF of the passivated catalyst was determined. These results also are presented in Table X. In addition, tests were conducted in which the indicated catalyst samples alternately were exposed to a hydrogen passivation zone for one minute and to a typical regeneration zone atmosphere comprising 2% oxygen for ten minutes to simulate a commercial cracking system. Gas Producing Factors were obtained at various cumulative residence times in the passivation zone. Plots of the degree of passivation $GPF/GPF_o$ for Super DX catalyst without impregnated passivation promoter, with 2000 wppm tin, and with 2000 wppm cadmium are presented in FIG. 3. $GPF_o$ is the Gas Producing Factor obtained with no hydrogen passivation. Use of the term $GPF/GPF_o$ serves to minimize any inherent differences in contaminant metal activity of the catalyst samples, and permits comparison of the relative degrees of passivation as a function of cumulative hydrogen passivation residence time.

EXAMPLE V

Samples of the Super-DX metal contaminated cracking catalyst having a combination of 1000 wppm tin and 1000 wppm cadmium also were placed in a passivation zone maintained at 704° C. for varying residence times after which the GPF of the passivated catalysts was determined. The GPF data for the combination of tin and cadmium also is presented in Table X. As may be seen from Table X, the use of a passivation zone and no passivating agent reduced the GPF of the cracking catalyst. The addition of cadmium, tin, or a combination of cadmium and tin all reduced the GPF still further. However, it should be noted that the combination of cadmium and tin reduced the GPF below that of equivalent weights of either cadmium or tin alone, particularly at short residence times, i.e., about five minutes or less.

EXAMPLE VI

Figure 2:
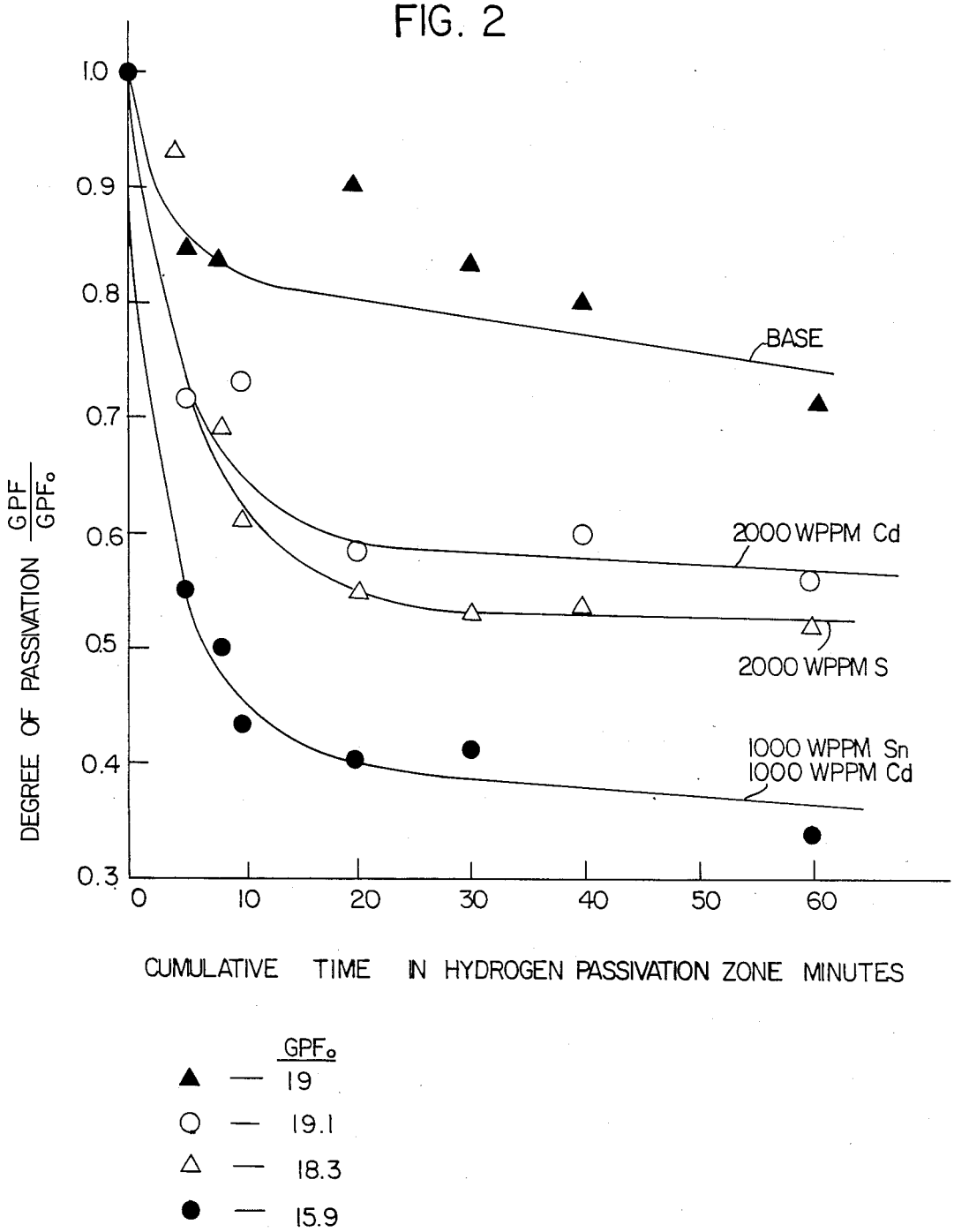
FIG. 2 is a plot of the degree of passivation for various metal contaminated cracking catalyst samples as a function of cumulative residence time in a passivation zone.

A sample of Super DX cracking catalyst contaminated with 1000 wppm Ni and 4000 wppm V was exposed alternately to one minute in a hydrogen passivation zone and to ten minutes in a regeneration zone comprising 2% oxygen to simulate a commercial cracking system. Gas Producing Factors were obtained at various cumulative residence times in the passivation zone and also are presented in FIG. 2. As shown in FIG. 2, the combination of 1000 wppm tin and 1000 wppm cadmium produced a higher degree of passivation than either 2000 wppm tin, 2000 wppm cadmium or catalyst without passivation promoter.

TABLE X

GAS PRODUCING FACTORS

| Residence Time in Passivation Zone, Mins. | No Passivation Zone and No Passivation Promoter | Passivation Zone But No Passivation Promoter | Passivation Zone and 2,000 wppm Tin | Passivation Zone and 2,000 wppm Cadmium | Passivation Zone and Combination of 1,000 wppm Tin and 1,000 wppm Cadmium |
|---|---|---|---|---|---|
| 0 | 19.0 | 19.0 | 14.6 | 18.3 | 16.4 |
| 5 | 19.0 | 15.6 | 11.0 | 12.1 | 8.4 |
| 10 | 19.0 | 12.9 | 7.9 | 8.1 | 7.4 |
| 20 | 19.0 | 9.5 | 6.1 | 5.5 | 6.1 |
| 90 | 19.0 | 5.8 | 5.5 | 4.8 | 4.9 |

The passivation promoters may be added to the cracking system or impregnated onto the cracking catalyst in elemental form or as a compound which may decompose to deposit the passivation promoter on the catalyst.

Among the preferred cadmium, germanium, indium, tellurium and zinc compounds are metal organic, organic or inorganic complex salts, with metal organic oil soluble compounds being particularly preferred. The particular passivation promoter which is utilized will be dependent on many factors, including availability, process economics, corrosion, and desired degree of passivation. Particularly preferred passivation promoters include cadmium, germanium, zinc, tin and compounds thereof, with cadmium and compounds thereof being especially preferred.

From the data presented above, it can be seen that the combination of reducing gas passivation at elevated temperature and the use of the previously enumerated passivation promoters was more effective than either treatment alone, particularly at passivation zone residence times of about 5 minutes or less, which would be greater than typical residence times for cracking catalyst in a transfer line passivation zone. The combination of the use of one or more passivation promoters and the reducing zone operated at elevated temperature to passivate metal contaminants present on cracking catalyst is of particular utility where the passivation zone is disposed in the transfer zone.

The amount of passivation promoter which is utilized will be dependent on several factors, including the particular promoter utilized, the metal contaminant content on the catalyst, the desired degree of passivation, the average catalyst residence time in the passivation zone, and the conditions in the passivation zone. The amount of passivation promoter which is used typically will range between about 0.005 and about 0.20 weight percent of the catalyst, preferably between about 0.025 and 0.10 weight percent of the catalyst.

The method by which the passivation promoter is added to the catalyst is not believed to be critical. The passivation promoter may be impregnated directly into the catalyst before use, or it may be added to the cracking system during operation. To maintain the desired degree of passivation, a preferred method is to add the passivation promoter directly to the cracking system, preferably by adding a slip stream of the passivation promoter in a suitable carrier to the reaction zone.

In a typical commercial cracking system such as that shown in FIG. 1 catalyst residence time in the transfer zone, comprising sandpipe 42 and U-bend 44, typically is about 0.1 to about 2 minutes. Thus, the transfer zones typically have sufficient residence time to passivate catalyst upon the introduction of reducing gas.

The reducing agent utilized in the passivation zone is not critical. It is believed that commercial grade CO and process gas streams containing $H_2$ and/or CO can be utilized. Hydrogen or a reducing gas stream comprising hydrogen is preferred, since this achieves the highest rate of metals passivation and the lowest level of metal contaminant potency. Preferred reducing gas streams containing hydrogen include catalytic cracker tail gas streams, reformer tail gas streams, spent hydrogen streams from catalytic hydroprocessing, synthesis gas, steam cracker gas, flue gas, and mixtures thereof. The reducing gas content in the passivation zone should be maintained between about 2% and about 100%, preferably between about 10% and about 75% of the total gas composition depending upon the hydrogen content of the reducing gas and the rate at which the reducing gas can be added without adversely affecting the catalyst circulation rate.

What is claimed is:

1. A method for reducing the adverse catalytic effects of a metal contaminant selected from the group consisting of nickel, vanadium, iron and mixtures thereof present in a hydrocarbon feedstock processed in a cracking system comprising a reaction zone, a regeneration zone, and a catalyst transfer means communicating between the reaction zone and the regeneration zone, said method comprising:

A. contacting the hydrocarbon feedstock containing the metal contaminant with cracking catalyst in the reaction zone under cracking conditions to produce cracked hydrocarbon product and coke, coke and metal contaminant being deposited on the cracking catalyst;

B. passing coke and metal contaminated catalyst from the reaction zone to the regeneration zone maintained under regeneration conditions to remove coke from the catalyst;

C. passing said coke removed, metal contaminated catalyst through a passivation zone maintained under net reducing conditions at an elevated temperature, the passivation zone disposed in a catalyst transfer means adapted to return regenerated catalyst to the reaction zone, the transfer means having a flow control means adapted to regulate the flow rate of said regenerated catalyst from the regeneration zone to the reaction zone;

D. adding passivation rate enhancer to the cracking system comprising metal or compound of a metal selected from the group consisting of cadmium, germanium, indium, tellurium, zinc, or mixtures thereof; and E. monitoring the catalyst level in the transfer means and/or in the regeneration zone and regulating the flow control means in response thereto to thereby regulate the residence time of the catalyst in the passivation zone.

2. The method of claim 1 wherein the transfer means comprises a standpipe and a U-shaped member.

3. The method of claim 2 wherein the flow control means is disposed in the standpipe.

4. The method of claim 3 wherein the flow control means comprises a slide valve.

5. The method of claim 1 further comprising the addition of reducing gas to the transfer means to thereby maintain the passivation zone under said net reducing conditions.

6. The method of claim 5 wherein the rate of addition of the reducing gas to the catalyst transfer means is regulated in response to temperature in the regeneration zone.

7. The method of claim 6 wherein the regeneration zone comprises a dense phase and a dilute phase and wherein a temperature control means maintains the temperature of the dilute phase below about 760° C.

8. The method of claim 5 wherein the rate of addition of the reducing gas is regulated in response to the catalyst circulation rate.

9. A method for reducing the adverse catalytic effects of a metal contaminant selected from the group consisting of nickel, vanadium, iron and mixtures thereof present in a hydrocarbon feedstock processed in a cracking system comprising a reaction zone, a regeneration zone, and a catalyst transfer means communicating between the reaction zone and the regeneration zone, said method comprising:

A. contacting the hydrocarbon feedstock containing the metal contaminant with cracking catalyst in the reaction zone under cracking conditions to produce cracked hydrocarbon product and coke, coke and metal contaminant being deposited on cracking catalyst;

B. passing coke and metal contaminated catalyst from the reaction zone to the regeneration zone maintained under regeneration conditions to remove coke from the catalyst;

C. passing said coke removed, metal contaminated catalyst through a passivation zone maintained under net reducing conditions at an elevated temperature, the passivation zone disposed in the catalyst transfer means adapted to return regenerated catalyst from the regeneration zone to the reaction zone, the transfer means having a flow control means disposed therein adapted to regulate the flow rate of said regenerated catalyst from the regeneration zone to the reaction zone;

D. adding passivation rate enhancer to the cracking system comprising metal or compound of a metal selected from the group consisting of cadmium, germanium, indium, tellurium, zinc, or mixtures thereof;

E. monitoring the catalyst level in the transfer means and/or in the regeneration zone and regulating the flow control means in response thereto; and F. adding reducing gas to the passivation zone to maintain said net reducing conditions.

* * * * *

UNITED STATES PATENT AND TRADEMARK OFFICE

CERTIFICATE OF CORRECTION

PATENT NO. : 4,666,584

DATED : May 19, 1987

INVENTOR(S) : Edward C. Luckenbach and Carl F. Bertsch

It is certified that error appears in the above-identified patent and that said Letters Patent is hereby corrected as shown below:

The term of this patent subsequent to March 12, 2002, has been disclaimed.

Signed and Sealed this

Twenty-seventh Day of December, 1988

*Attest:*

DONALD J. QUIGG

*Attesting Officer*

*Commissioner of Patents and Trademarks*